US005424609A

United States Patent [19]

Geven et al.

[11] Patent Number: 5,424,609

[45] Date of Patent: Jun. 13, 1995

[54] HIGH-PRESSURE DISCHARGE LAMP

[75] Inventors: Andreas S. G. Geven; Max L. P. Renardus; Peter A. Seinen, all of Eindhoven, Netherlands; Jan A. J. Stoffels, Turnhout, Belgium; Christoffel Wijenberg, Eindhoven, Netherlands; Harald R. Dielis, Turnhout, Belgium

[73] Assignee: U.S. Philips Corporation, New York, N.Y.

[21] Appl. No.: 115,334

[22] Filed: Sep. 1, 1993

[30] Foreign Application Priority Data

Sep. 8, 1992 [EP] European Pat. Off. ..... 92202712

[51] Int. Cl.[6] ..... H01J 61/30

[52] U.S. Cl. ..... 313/623; 313/624; 313/625; 313/634; 313/331

[58] Field of Search ..... 313/623, 624, 625, 626, 313/631, 634, 642, 331, 332

[56] References Cited

U.S. PATENT DOCUMENTS 3,363,133 1/1968 Harris et al. .
4,409,517 10/1983 Van Der Sande et al. .
4,625,149 11/1986 Danno et al. ..... 313/623
4,766,347 8/1988 Janssen et al. ..... 313/625 X
4,780,646 10/1988 Lange .
4,864,191 9/1989 Van De Weiger et al. ... 313/631 X

*Primary Examiner*—Michael Horabik
*Assistant Examiner*—N. D. Patel
*Attorney, Agent, or Firm*—Brian J. Wieghaus

[57] ABSTRACT

A high-pressure discharge lamp of the invention includes a ceramic discharge vessel (10) in which a first and a second electrode (40*a*, 40*b*) are arranged and which encloses a discharge space (11 ) which is provided with a filling containing a metal halide. The discharge vessel (10) has a central zone (20) between the electrodes (40*a*, 40*b*) and a first and a second cylindrical end zone (30*a*, 30*b*) which each surround a current supply conductor (50*a*, 50*b*) connected to a respective electrode (40*a*, 40*b*). At least the first end zone (30a) has a diameter smaller than the smallest diameter of the central zone (20). The current supply conductor (50*a*) through the first end zone (30*a*) has a halide resistant portion (51*a*) which faces the discharge space (11) and a portion (52*a*) permeable to hydrogen and oxygen and facing away from the discharge space (11). The halide resistant portion (51*a*) extends through the first end zone (30*a*) over a distance that is at least the inner diameter D of the first end zone (30*a*) augmented by 2 mm. Furthermore, the current supply conductor (50*b*) through the second end zone (30*b*) has a halide resistant portion (51*b*) which faces the discharge space (11). The construction allows for a sufficient reduction of the amount of hydrogen and oxygen in the discharge vessel (10), while corrosive attack of the current supply conductors (50*a*, 50*b*) by halides is prevented.

19 Claims, 4 Drawing Sheets

HIGH-PRESSURE DISCHARGE LAMP

BACKGROUND OF THE INVENTION

The invention relates to a high-pressure discharge lamp comprising a ceramic discharge vessel which encloses a discharge space which is provided with an ionizable filling comprising metal halide and in which a first and a second electrode are arranged, which discharge vessel comprises, on either side of a central zone extending between the electrodes, a first and a second end zone which are connected to the central zone, which each surround with little clearance a current supply conductor connected to a respective electrode, and in which a seal of ceramic sealing compound is provided through which said current supply conductor issues to the exterior, in which lamp at least the first end zone has an external diameter smaller than the smallest external diameter of the central zone and the current supply conductor through the first end zone has a halide-resistant portion facing the discharge space and a portion which is permeable to hydrogen and oxygen remote from the discharge space.

Such a lamp is known from U.S. Pat. No. 4,409,517. The term "ceramic discharge vessel" in the present description and claims is understood to mean a discharge vessel of a refractory material such as monocrystalline metal oxide, for example sapphire, polycrystalline metal oxide, for example translucent gastight aluminium oxide (DGA), yttrium-aluminium garnet (YAG) or yttrium oxide (YOX), or polycrystalline non-oxidic material such as aluminium nitride (AlN). The term "halide resistant" means that no or substantially no corrosive attack by halides and free halogens takes place under the conditions prevailing in the discharge space during lamp operation. The term "little clearance" means that the space remaining between the end zone and the current supply conductor issuing through it is at least 5 μm and at most one fourth of the internal diameter of the end zone, but not more than approximately 200 μm. So the diameter of the current supply conductor therein is at least equal to half the internal diameter of the end zone. In the known lamp, a metal bush forming a current supply conductor is passed through each of the end zones of the discharge vessel. The space remaining between the bush and the end zone is entirely filled with a ceramic sealing compound. Niobium or tantalum is used as the material for the current supply conductor because these metals have coefficients of expansion, averaged over the temperature range which the end zone experiences after the lamp has been switched on from an idle state, which correspond substantially to those of the ceramic materials from which the discharge vessel is manufactured. A disadvantage of the said metals, however, is that they are not halide resistant. Accordingly, the current supply conductor issuing into the discharge vessel through the first end zone in the known lamp is provided with a cover of halide-resistant material such as molybdenum or tungsten at a portion situated inside the discharge space.

It has been found to be difficult as a rule to avoid that hydrogen enters the discharge vessel during the manufacture of high-pressure discharge lamps comprising metal halide, or that hydrogen is evolved in a later stage through dissociation of water present in the discharge vessel, for example, absorbed in the metal halide salts. Small quantities of hydrogen can already cause a strong rise in the ignition voltage and re-ignition voltage of the lamp. It is also possible for parasitic reactions with oxygen to occur, which can lead to a black discolouration of the discharge vessel and also to a rise in the (re-)ignition voltage. A ratio of re-ignition voltage to lamp voltage greater than 2 involves the risk of the lamp extinguishing during operation on a conventional lamp supply. To counteract these disadvantages, the current supply conductor through the second end zone is entirely made of niobium or tantalum in the known lamp. This is because these metals are highly permeable to hydrogen and oxygen. These gases can leave the discharge vessel through this current supply conductor.

To prevent attacks on the current supply conductor issuing from the second end zone in a lamp of this construction, it is necessary to operate the lamp in vertical or substantially vertical position so that a separation takes place in the discharge vessel whereby the halides and free halogens are present mainly in the end zone situated in the upper part. A disadvantage is also that the use of the construction of the known lamp is usually only possible for lamps having a sufficiently long and narrow discharge vessel. Lamps having a comparatively short and wide discharge vessel are usually so operated that the fill ingredients have a comparatively high vapour pressure to render possible the realisation of a sufficiently high lamp voltage in spite of the small discharge vessel length. Under these circumstances there is a risk that, given a vertical position of the discharge vessel, a too strong convection flow will take place for achieving a separation and thus for preventing attacks on the current supply conductor which issues through the second end zone.

SUMMARY OF THE INVENTION

It is an object of the invention to provide a high-pressure discharge lamp of the kind described in the opening paragraph which has a construction in which the occurrence of a convection flow is unnecessary for preventing corrosive attacks on current supply conductors, while rendering it nevertheless possible to limit the presence of hydrogen and oxygen in the discharge vessel to a sufficient degree.

According to the invention, the lamp is for this purpose characterized in that the halide-resistant portion of the current supply conductor extends inside the first end zone over a distance L1 which is at least the internal diameter D of the first end zone augmented by 2 mm, and in that the current supply conductor through the second end zone also has a halide-resistant portion which faces towards the discharge space.

The inventors have found that exposure of the permeable portion to halogens and free halides under these circumstances does not lead to attacks thereon. In the case of a smaller distance, exposure of the permeable portion to halogens and free halides did lead to attacks, so it was found, and an unacceptably short lamp life was the result. For reasons of favourable manufacturing technology, the distance L1 is preferably not greater than approximately 30 min. Since the halide-resistant portion of the current supply conductor of the lamp according to the invention runs through the end zone over at least the distance L1 defined above and thereby transfers radiation heat to the surroundings, the permeable portion has a comparatively low temperature compared with the temperatures prevailing inside the discharge space. It is also assumed that the little clearance between the end zone and the halide-resistant portion running through it leads to a strong heat exchange between the gases originating from the discharge space and the halide-resistant portion, so that also the gases originating from the discharge space already have a comparatively low temperature as a result before reaching the permeable portion. This renders it possible to remove hydrogen and oxygen through the space between the halide-resistant portion and the end zone and through the permeable portion from the discharge vessel during operation of the lamp, without this leading to a loss of filling components owing to undesirable reactions of these components with the permeable portion.

It is noted that U.S. Pat. No. 4,780,646 discloses a high-pressure discharge lamp whose discharge vessel is provided with a filling comprising metal halides. The current supply conductor at an end zone of the discharge vessel has a halide-resistant portion. The end zone, which has the same diameter as the central zone of the discharge vessel, has a complicated construction involving a niobium current conductor which is connected to a pin of an electrode via a disc which is also made of niobium, two ceramic discs, in recesses of which the niobium disc is accommodated, and a ceramic sleeve which surrounds the pin of the electrode. On the one hand, there is sufficient space between the sleeve and the pin for accommodating the difference in average coefficient of expansion between the pin and the sleeve. On the other hand, the space is so small that condensed filling components are prevented from depositing or moving therein. A disadvantage of the lamp is, apart from the complicated construction of the end zone, that the surface area of the niobium disc available for the transport of hydrogen and oxygen is only very small and cannot be made larger without also increasing the accessibility to condensed filling components.

It is further noted that a high-pressure discharge lamp is known from Netherlands Patent Application 8005026 laid open to public inspection in which the discharge vessel has a cylindrical end zone on either side of a central zone, the diameter of the end zone being comparatively small in relation to that of the central zone. A current conductor of niobium, permeable to hydrogen and oxygen, is passed through each of the end zones into the discharge space, and is connected to an electrode pin of halide-resistant tungsten. The electrode pin, which has a diameter smaller than half the internal diameter of the end zone, does not extend to inside the end zone. The use of metal halides in the filling, as proposed in the Application laid open to public inspection, would lead to attacks on the niobium current conductor in a lamp of this construction after only a short period of operation.

In the lamp according to the invention, the permeable portion of the current supply conductor is made, for example, of titanium, zirconium, hafnium, vanadium, niobium, or tantalum, or an alloy of these elements. The use of niobium and/or tantalum is preferred because their average coefficients of expansion differ only slightly from those of the frequently used DGA. There is also only a slight difference with the average coefficients of expansion of yttrium oxide and yttrium-aluminium garnet. When aluminium nitride is used as the ceramic material, zirconium will be a favourable choice in this respect.

At least the surface of the halide-resistant portion of the current supply conductor is preferably manufactured from a material which comprises at least one of the metals from the group formed by tungsten, molybdenum, platinum, iridium, rhenium and rhodium, and/or an electrically conducting silicide, carbide or nitride of at least one of these metals, for example, molybdenum disilicide.

The surface of the halide-resistant portion preferably has a radiation absorption coefficient in excess of 0.2. A comparatively high absorption coefficient promotes the transfer of radiation heat to the surroundings so that the permeable portion has a comparatively low temperature, all other circumstances remaining equal. An absorption coefficient in excess of 0.2 is realised in a simple manner, for example, in that the surface of the halide-resistant portion is rendered rough and/or dull. Alternatively, the surface of the halide-resistant portion may be provided, for example, with a layer of a material having a high absorption coefficient.

In an embodiment of the lamp according to the invention, the permeable portion enters the first end zone to beyond the seal of ceramic sealing compound and adjoins the halide-resistant portion at some distance from the seal. In this embodiment, an end of the permeable portion of the current supply conductor facing towards the halide-resistant portion is in contact with the discharge space via the space between the end zone and the halide-resistant portion which passes through this zone, so that hydrogen and oxygen can leave the discharge space through the said end.

The second end zone of a lamp according to the invention may be comparatively short and may be provided with a tungsten or molybdenum rod which forms both the current supply conductor and the electrode. Alternatively, the second end zone may have a construction which corresponds to that of the first end zone, Although water dissociates in the discharge during normal lamp operation and hydrogen and oxygen can leave the discharge vessel through the permeable portion of the current supply conductor, there is a risk that the presence of hydrogen increases the ignition voltage to such an extent that it takes a considerable time before the lamp ignites on a conventional supply device and the process described above is set in motion. Preferably, therefore, hydrogen, oxygen and water are driven from the discharge vessel during manufacture already. A higher ignition voltage may be used during this, if necessary.

In a preferred embodiment of the lamp according to the invention, the halide-resistant portion of the current supply conductor extends to inside the seal of ceramic sealing compound. In this embodiment, the permeable portion of the current supply conductor is completely screened off from the filling comprising the metal halide in the finished lamp. Given the same external dimensions of the first end zone, higher temperatures thereof can be permitted compared with the construction in which an end of the permeable portion is in contact with the discharge space. Although in this construction the permeable portion of the current supply conductor is entirely covered with ceramic sealing compound in the first end zone, it is nevertheless possible to remove water, hydrogen and oxygen from the discharge vessel during lamp manufacture. For this purpose, for example, an assembly comprising an electrode and a current supply conductor having a permeable portion and a halide-resistant portion is inserted in the first end zone and so fixed with ceramic sealing compound that an end of the permeable portion of the current supply conductor adjoining the halide-resistant portion is still uncovered. Subsequently, the lamp is operated for a few minutes, whereby water vapour dissociates in the discharge arc and hydrogen and oxygen leave the discharge vessel through the said end. When a current supply conductor with a permeable portion of niobium is used, the lamp may be, for example, heated in a furnace as an alternative. The water vapour generated thereby then dissociates at the surface of the permeable portion. This process also takes place with the metals titanium, zirconium, hafnium, vanadium, and tantalum. After water, hydrogen and oxygen have been removed from the discharge vessel to a sufficient extent, the ceramic sealing compound is re-melted until it extends over the entire permeable portion.

It is noted that U.S. Pat. No. 3,363,133 discloses a high-pressure discharge lamp with a discharge vessel provided with a filling comprising metal halide. The discharge vessel has end zones of the same external diameter as the central zone, current supply conductors being passed through said end zones and comprising a niobium conductor and an electrode pin of halide-resistant material connected to this conductor. The halide-resistant electrode pin extends to inside a seal of ceramic sealing compound. The construction hampers the removal of hydrogen and oxygen from the discharge vessel. The seal of ceramic sealing compound prevents transport of hydrogen and oxygen to the permeable portion of the assembly in the finished lamp. Since it is practically impossible to provide the seals of ceramic sealing compound at the inside of the discharge vessel after the discharge vessel has been closed, it is also very difficult to remove hydrogen and oxygen from the discharge vessel during the manufacture of this lamp without a concomitant loss of desired filling ingredients.

In the lamp according to the invention, the permeable portion extends preferably within the first end zone over a distance L2 which is at least three times the internal diameter D of the first end zone. Without special measures, it can then be readily realised that the ceramic sealing compound leaves an end of the permeable portion adjoining the halide-resistant portion exposed, if so desired, or covers it entirely, for example, after a second melting of the ceramic sealing compound.

An attractive embodiment of the lamp according to the invention is characterized in that the halide resistant portion is a solid rod of halide-resistant material. In this embodiment, the current supply conductor may be manufactured by techniques which are known for connecting, for example, a niobium current supply conductor to a tungsten electrode. The electrode and the halide-resistant portion of the current supply conductor may be jointly formed, for example, by a tungsten rod.

In a favourable modification of this embodiment, the halide-resistant portion of the current supply conductor is surrounded by a sleeve which comprises platinum, rhodium, and/or iridium. The current supply conductor with the sleeve can be enclosed in the first end zone with close fit also when the halide-resistant portion extends to inside the seal of ceramic sealing compound and/or when a comparatively great difference between the average coefficients of expansion of the material of the discharge vessel and that of the halide-resistant portion exists, because platinum, rhodium and iridium are elastic materials. A close fit, i.e. a difference between the external diameter of the halide-resistant portion and the internal diameter of the end zone of 5 to 100 mm, counteracts a loss of filling ingredients in the space between the first end zone and the halide-resistant portion of the current supply conductor, but does not prevent transport of hydrogen, oxygen and water vapour.

In an alternative modification of this embodiment, the halide-resistant portion of the current supply conductor has a comparatively narrow end adjoining the permeable portion and a comparatively wide end facing the central zone of the discharge vessel. This has the advantage in a lamp in which the halide-resistant portion extends to inside the ceramic sealing compound that the mechanical stresses in the first end zone remain limited also when the average coefficient of expansion differs comparatively strongly from that of the ceramic sealing compound and that of the material from which the first end zone is manufactured, while nevertheless the ceramic sealing compound is effectively screened from the discharge space by the wide end.

A practical implementation of this modification is characterized in that the ceramic sealing compound extends up to the comparatively wide end. The surface of the ceramic sealing compound facing the discharge space is substantially covered by the comparatively wide portion as a result, so that a still better screening thereof is obtained.

In a favourable embodiment of the lamp according to the invention, the halide-resistant portion is a hollow rod. Such a rod can be enclosed with close fit in the first end zone also when a material is used whose average coefficient of expansion differs comparatively strongly from that of the ceramic sealing compound and that of the first end zone. This embodiment has the additional advantage that the rod, compared with a solid rod of the same dimensions, has the same surface area available for heat radiation, but conducts less heat towards the permeable portion. As a result, this construction renders possible a lower temperature of the permeable portion without an increase in the length of the end zone.

A favourable embodiment of the lamp according to the invention is characterized in that the current supply conductor comprises a rod of permeable material, while the halide-resistant portion is formed by a narrowed portion of the rod and a cover of halide-resistant material which is passed over the narrowed portion. This embodiment has the advantage that the permeable portion and the halide-resistant portion of the current supply conductor can be readily interconnected.

An attractive embodiment is characterized in that the current supply conductor comprises a rod of permeable material, while the halide-resistant portion is formed by a portion of the rod which is provided with a layer of halide-resistant material. In a practical implementation, the current supply conductor is formed, for example, from a niobium rod, and an end portion thereof is provided with a tungsten layer of a thickness of, for example, a few up to a few tens of micrometers. To safeguard a good protection of the rod against attacks also in the longer term, a heat treatment is preferably carried out by which the material of the layer penetrates somewhat into the niobium and a very good adhesion of the tungsten layer to the niobium rod is obtained. The heat treatment comprises, for example, heating of the rod for a few hours at a temperature of 2200K. This embodiment has the advantage that the current supply conductor can be manufactured from a single rod, while in addition further shaping operations are redundant.

In a further favourable embodiment of the lamp according to the invention, the halide-resistant portion of the current supply conductor is a porous body. Mechanical stresses in the first end zone remain limited also when the porous body is made of a material having an average coefficient of expansion which deviates strongly from that of the first end zone and when this body is passed through the first end zone with close fit. The porous body has a rough surface, which promotes the radiation of heat to the surroundings. Also, cross-sections of the body have a comparatively small surface area compared with that of a solid rod of the same external dimensions. Both factors render possible a comparatively low temperature of the permeable portion given certain defined external dimensions.

A further attractive embodiment of the lamp according to the invention is characterized in that the halide-resistant portion is manufactured from a cermet of preferably at least 10% by volume of a halide-resistant ceramic material such as MgO, $Al_2O_3$, $Sc_2O_2$, $Y_2O_3$ with one or several halide-resistant conductive materials, for example, with tungsten or with molybdenum disilicide. As a result of the presence of the ceramic material in the cermet, in particular when the same ceramic material is used as the one from which the discharge vessel is manufactured, and especially in a concentration in excess of 30 vol %, the halide-resistant portion has an average coefficient of expansion which corresponds to a high degree to that of the ceramic sealing compound and of the first end zone. An advantage is also that the cermet has a comparatively low heat conductivity because of the presence of the ceramic material therein. This renders it possible to realise a comparatively low temperature of the permeable portion with a comparatively small length of the halide-resistant potion. At a concentration below 80% by volume of the ceramic material, randomly distributed particles of the electrically conducting material in the cermet will form together an electrically conducting path. At a higher concentration of the ceramic material, it is necessary for achieving electrical conduction through the cermet to provide a certain distribution pattern of the particles of the electrically conducting material in the cermet. Preferably, the concentration of the ceramic material in the cermet is smaller than 50 vol %. The cermet then has a sufficiently low electrical resistance under all circumstances.

A yet further attractive embodiment of the high-pressure discharge lamp according to the invention is characterized in that the halide-resistant portion is surrounded by a winding of a wire which comprises at least one of the metals tungsten, molybdenum, platinum, iridium, rhenium and rhodium. This embodiment has the advantage that the space left open in the end zone can be small without this leading to mechanical stresses with temperature fluctuations. A small open space has the advantage that it can hold few fill ingredients. The reproducibility of the lamp behaviour is increased by this.

Preferably, the winding is manufactured from a wire having a diameter of between one fourth and half the diameter of the halide-resistant portion surrounded thereby. The wire is then on the one hand thick enough for readily avoiding its fracture during manufacture, and on the other hand not so thick that special measures are necessary for coiling it around the halide-resistant portion.

The first end zone is sintered directly, for example, into an end of the central zone. A favourable embodiment, however, is characterized in that an end of a tube forming the first end zone facing towards the central zone is fixed in a ceramic ring which is fastened in a respective end of the tube forming the central zone. This embodiment has the advantage that little heat is necessary for forming the seal of ceramic sealing compound during manufacture. Special measures for preventing filling ingredients from evaporating during this are then unnecessary. A similar construction may be used, for example, at the second end zone.

BRIEF DESCRIPTION OF THE DRAWINGS

This and other aspects of the high-pressure discharge lamp according to the invention will be explained in more detail with reference to the drawings, in which.

It is noted that the relative dimensions of the components in FIGS. 2 to 8 are not depicted true to scale.

DESCRIPTION OF THE PREFERRED EMBODIMENTS

Figure 1:
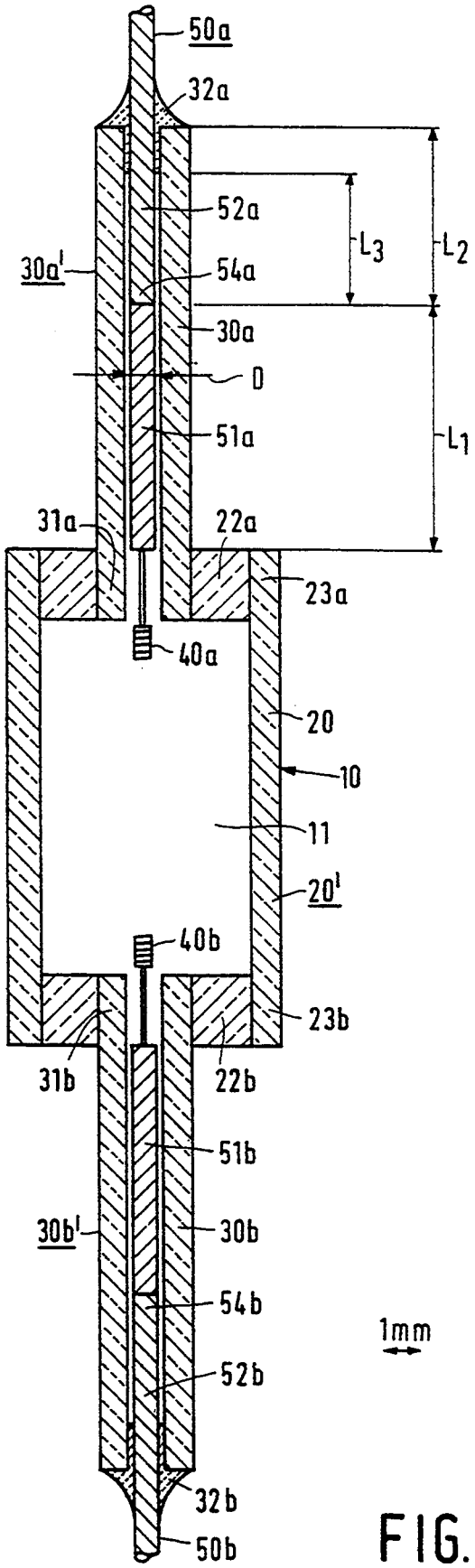
FIG. 1 shows an embodiment of the lamp according to the invention in longitudinal section.

The high-pressure discharge lamp shown in FIG. 1 comprises a ceramic discharge vessel 10 made of DGA material which encloses a discharge space 11 and is provided with an ionizable filling comprising metal halides. In this case the filling comprises 1 mg mercury and 3 mg of the metal halides sodium iodide, thallium iodide and dysprosium iodide in a weight ratio of 69:10:21. The filling also comprises argon and a starting gas. The spectrum of the lamp shows lines at 589 nm and 535 nm which result from the respective first two metal halide components, and in addition exhibits a multitude of lines generated by the third metal halide component. Instead of dysprosium iodide, for example, a halide of a different rare earth such as scandium iodide, yttrium iodide, holmium iodide or thulium iodide may be used. Alternatively, the filling may comprise, for example, halides which radiate a continuous spectrum during operation, such as tin iodide. A first and a second electrode 40*a*, 40*b* are arranged in the discharge vessel 10. The electrodes 40*a*, 40*b* are each formed by a tungsten rod with a length of 3 mm and a diameter of 300 μm, while having a single winding of tungsten wire of 170 μm diameter at a free end over a distance of 800 μm.

The discharge vessel 10 has a central zone 20 which extends between the electrodes 40*a*, 40*b* and further has on either side of this zone a first and a second cylindrical end zone 30*a*, 30*b* connected to the central zone 20 and each surrounding a current supply conductor 50*a*, 50*b* with little clearance, which current supply conductors are connected to respective electrodes 40*a*, 40*b*. A seal 32*a*, 32*b* of ceramic sealing compound is provided in each end zone, through which seal the relevant current supply conductor 50*a*, 50*b* issues to the exterior. The central zone 20 has an internal length of 10 mm, an external diameter of 7.6 mm and a wall thickness of 0.8 mm. Ends 31*a*, 31*b* of tubes 30*a*′, 30*b*′ facing towards the central zone 20 and forming the end zones 30*a*, 30*b* are in this case fixed each in a ring 22*a*, 22*b*. The rings 22*a*, 22*b* of 2 mm thickness are each fastened in an end 23*a*, 23*b* of a tube 20′ which forms the central zone 20. Ends 31*a*, 31*b*, rings 22*a*, 22*b*, and ends 20*a*, 20*b* here form transition zones interconnecting the end zones 30*a*, 30*b* and the central zone. The end zones 30*a*, 30*b* have an external diameter which is small in relation to that of the central zone 10. Here the external diameter of the former is 2.6 mm. The end zones 30*a*, 30*b* have an internal diameter D of approximately 0.76 mm. The current supply conductors 50*a*, 50*b* each comprise a portion 51*a*, 51*b* facing towards the discharge space 11 and formed by a halide-resistant molybdenum rod of 0.70 mm diameter and a portion 52*a*, 52*b* facing away from the discharge space and formed by a 0.72 mm thick rod of niobium which is permeable to hydrogen and oxygen. The average clearance between the end zone 30*a*, 30*b* and the halide-resistant portion 51, 51*b* passed through it, accordingly, is approximately 0.03 mm.

The halide-resistant portion 51*a*, 51*b* extends over a distance L1 of 7 mm inside the end zone 30*a*, 30*b*. The distance L1 is greater than the internal diameter D of the end zone augmented by 2 mm, i.e. 2.76 mm. The halide-resistant portion 51, 51*b* has an absorption coefficient greater than 0.2 owing to its rough and dull surface. In this case the absorption coefficient is approximately 0.22.

The permeable portion 52*a*, 52*b* extends over a distance L2 of 5 mm inside the end zone 30*a*, 30*b*, which is more than three times the internal diameter D of the end zone (2.3 mm). The seal 32*a*, 32*b* of ceramic sealing compound leaves an end 54*a*, 54*b* with a length L3 of approximately 2 mm of the permeable portion 52*a*, 52*b* exposed.

The lamp consumes a power of 70 W during nominal operation.

The lamp was subjected to an endurance test of 5000 hours. After the endurance test, substantially no corrosion of the permeable portion 52*a*, 52*b* of the current supply conductor 50*a*, 50*b* was found. The ratio of re-ignition voltage to lamp voltage was smaller than 2 during the endurance test. A comparison lamp was manufactured whose components had dimensions corresponding to those of the embodiment described above, but in which the current supply conductor was; entirely made of niobium. After 1000 hours of operation of the lamp, a severe corrosion of the current supply conductor was already found in a region at a distance of 1.5 to 2 mm from the electrode.

Figure 2:
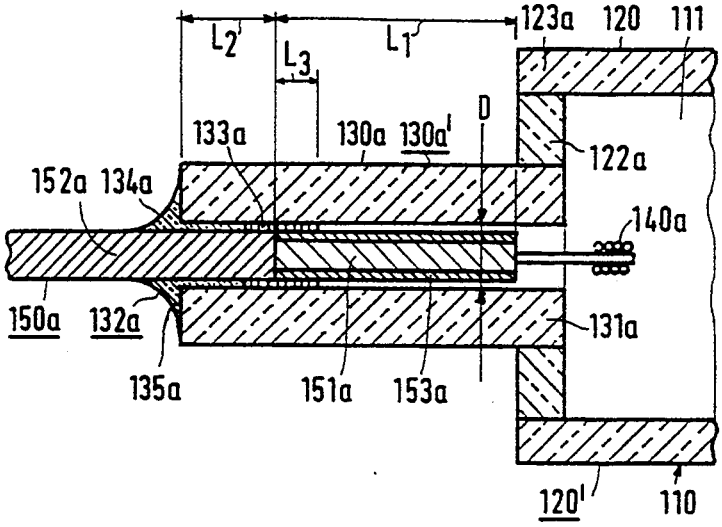
FIGS. 2 to 8 show the first end zones of further embodiments, also in longitudinal section.

In FIG. 2, components corresponding to those of FIG. 1 are given reference numerals which are 100 higher. FIG. 2 shows a modification of the previous embodiment in which the halide-resistant portion 151*a* of the current supply conductor 150*a* is surrounded by a sleeve 153*a* with an internal and an external diameter of 0.50 mm and 0.70 mm, respectively, and made of the elastic material platinum. Alternatively, for example, rhodium or iridium may be used. This lamp, of which the end zone is shown, consumes a power of 70 W during nominal operation. In this embodiment, the end zone also has an internal diameter D of 0.76 mm. The average clearance left open by the halide-resistant portion 151*a* in the end zone 130*a*, accordingly, is approximately 0.03 mm. The halide-resistant portion 151*a* of the current supply conductor 150*a* extends over a distance L1 of 8.5 mm inside the first end zone 130*a*, up to a distance L3 of 2 mm in the ceramic seal therein. The distance L1, accordingly, is greater than the internal diameter D of the end zone 130*a* augmented by 2 mm (2.76 mm). The permeable portion 152*a* has a diameter of 0.72 mm. The distance L2 over which the permeable portion extends inside the first end zone 130*a* is more than three times the internal diameter D of the end zone (2.3 mm). In this case the distance L2 is 3.5 mm. The seal 132*a* made of a ceramic sealing compound has a portion 133*a* which faces towards the discharge space 111 and has a composition of 30% $Al_2O_3$ by weight, 40% $SiO_2$ by weight and 30% $Dy_2O_3$ by weight, and a portion 134*a* facing way from the discharge space 111 and having a composition of 13% $Al_2O_3$ by weight, 37% $SiO_2$ by weight, and 50% MgO by weight.

The manufacture of the lamp may take place as follows, for example. The second end zone of the discharge vessel (not shown) is provided with an assembly of a current supply conductor and an electrode. Current supply conductor and electrode are jointly formed, for example, by a tungsten rod of 0.3 mm diameter, the electrode portion being provided with a single winding, also of tungsten. Then the discharge space 111 is provided with a filling, after which a second assembly of an electrode 140*a* and a current supply conductor 150*a* having a halide-resistant portion 151*a* and a permeable portion 152*a* is provided in the opposite first end zone 130. The end 135*a* of the first end zone 130*a* facing away from the central zone 120 is subsequently provided with a ring of a ceramic sealing compound comprising dysprosium oxide and heated until this ceramic sealing compound extends approximately 2 mm inside the first end zone 130*a*, while the permeable portion 152*a* of the current supply conductor 150*a* remains exposed over a distance of approximately 1.5 mm. Then the lamp is heated to a temperature of approximately 80° C. for a few minutes, and after that to a temperature of 600° to 1100° C. for 10 minutes, during which hydrogen and oxygen can leave the discharge vessel. Then a ring of a ceramic sealing compound comprising magnesium oxide is placed on the end 135*a* of the first end zone 130*a* facing away from the central zone 120. The first end zone 130*a* is then heated once again until the ceramic sealing compound comprising dysprosium oxide extends to approximately 2 mm beyond the permeable portion 152*a* of the current supply conductor 150*a* and a continuous seal is thus obtained comprising the seal 133*a* thus formed and the seal 134*a* comprising the ceramic sealing compound with magnesium oxide. The ceramic sealing compound comprising magnesium oxide at the end 135*a* facing away from the central zone 120 has an average coefficient of expansion which differs only slightly from that of DGA and thus contributes considerably to the mechanical strength of the entire seal 132*a*.

Figure 3:
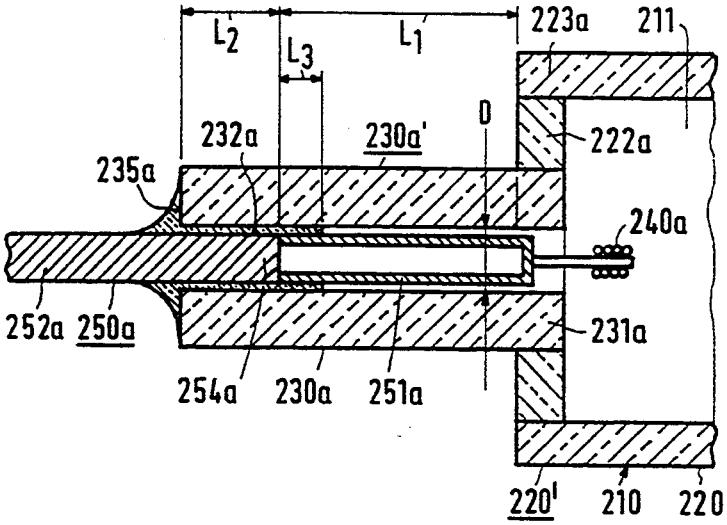

Components in FIG. 3 corresponding to those in FIG. 1 are given reference numerals which are 200 higher. In the embodiment shown in this Figure, the halide-resistant portion 251*a* of the current supply conductor 250*a* is a hollow pin with an internal diameter of 0.50 mm and an external diameter of 0.70 mm. The halide-resistant portion 251*a* has a length of 9.5 mm and extends over a distance L1 of 8.5 mm inside the end zone 230*a* which has an internal diameter D of 0.76 mm. A clearance of 0.03 mm is left open inside the end zone 230*a* by the halide-resistant portion 251. The distance L1 is more than the internal diameter D of the end zone augmented by 2 mm (2.76 mm). The permeable portion 252*a* is a solid rod of niobium with a diameter of 0.72 mm. The distance L2 over which the permeable portion 252*a* of the current supply conductor 250*a* extends inside the end zone is more than three times the internal diameter D of the end zone (2.3 mm) and in this case is approximately 3.5 mm. The halide-resistant portion 251*a* extends over a distance L3 of approximately 2 mm inside the ceramic seal 232*a*. The lamp consumes a power of 70 W during nominal operation.

Figure 4:
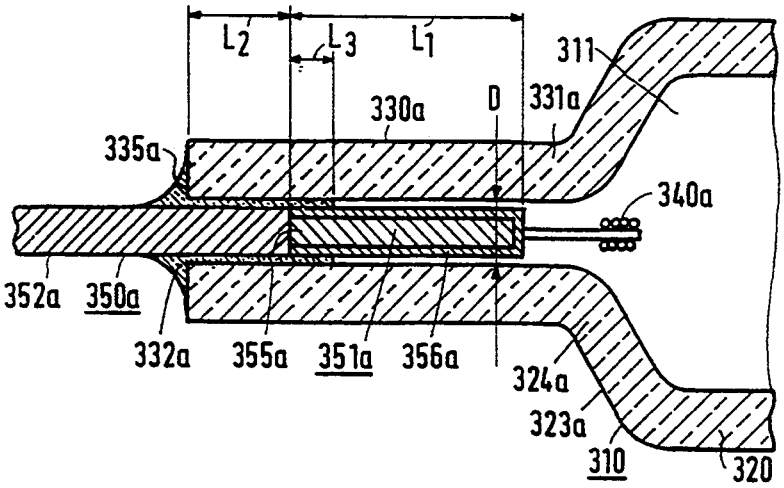

In FIG. 4, components corresponding to those of FIG. 1 are given reference numerals which are 300 higher. In the embodiment shown in this Figure, the halide-resistant portion 351*a* of the current supply conductor 350*a* is formed by a narrowed portion 355*a* of a rod forming the permeable portion 352*a* of the current supply conductor 350*a* and by a cover 356*a* of a halide-resistant material which has been passed over the narrowed portion 355*a*. In the embodiment shown, the discharge vessel narrows approximately conically towards the first end zone 330*a* at an end 323*a* of the central zone 320, and narrows further in a transition zone 324*a* so that the end zone 330*a* has an external diameter smaller than the smallest external diameter of the discharge vessel. The internal diameter D of the end zone is 0.62 mm. The narrowed portion 355*a* of the rod provided with the cover 356*a* extends over a distance L1 of 7.5 mm inside the end zone 330*a*, which is more than the internal diameter augmented by 2 mm (2.62 mm). The internal diameter of the cover 356*a* is 0.45 mm. The external diameter of the cover 356*a* is 0.56 mm, as is the diameter of the permeable portion 352*a*. The halide-resistant portion 351*a* accordingly leaves open a clearance of 0.03 inside the end zone 330*a*. The permeable portion extends over a distance L2 inside the end zone which is greater than three times the internal diameter D of the end zone (1.9 mm). In this case the distance L2 is 3 mm. The ceramic seal 332*a* extends over a distance of 5 mm inside the end zone 330*a*, to a distance L3 of approximately 2 mm beyond the permeable portion 352*a*. The power consumed by the lamp during nominal operation is 50 W.

Figure 5:
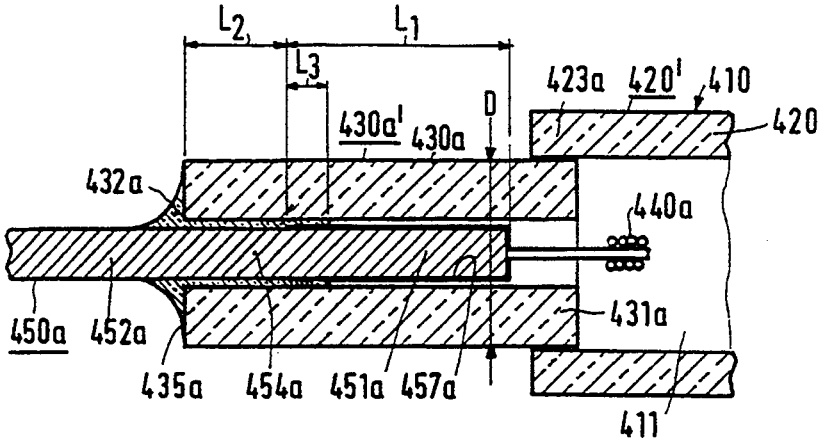

FIG. 5 shows a further embodiment. The components present therein and corresponding to those of FIG. 1 are given reference numerals which are 400 higher. In this embodiment, the current supply conductor 450*a* is a rod of 0.50 mm diameter made of tantalum, which is a material permeable to hydrogen and oxygen. A portion 451*a* of the rod is resistant to halides in that it is provided with a layer 457*a* of molybdenum having a thickness of 20 μm. An end 431*a* of a tube 430*a*' forming the first end zone 430*a* of the discharge vessel 410 is fixed through sintering in an end 423*a* of a tube 420' forming the central zone 420. The internal diameter D of the first end zone 430*a* is 0.58 mm. A clearance of 0.02 mm is left open between the first end zone 430*a* and the halide-resistant portion 451*a* passing through it. The halide-resistant portion 451*a* and the permeable portion 452*a* extend over a distance L1 of 5.5 mm and a distance L2 of 2.5 mm, respectively, inside the end zone 430*a*. The distance L1 is greater than the internal diameter D of the end zone 430*a* augmented by 2 mm, i.e. 2.58 mm. The distance L2 is greater than three times the internal diameter D (1.74 mm). The ceramic seal 432*a* covers the halide-resistant portion 451*a* over a distance L3 of 2 mm. The lamp consumes a power of 20 W during nominal operation.

Figure 6:
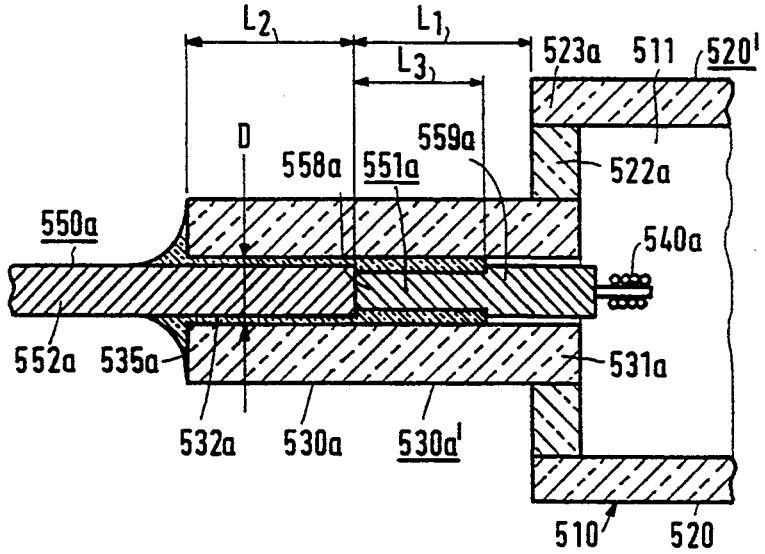

FIG. 6, in which components corresponding to those of FIG. 1 have reference numerals which are 500 higher, shows an embodiment in which the halide-resistant tungsten portion 551*a* of the current supply conductor 550*a* has a comparatively narrow end 558*a* with a length of 6 mm and a diameter of 0.67 mm adjoining the permeable niobium portion 552*a* of the current supply conductor 550*a*, and an adjoining comparatively wide end 559*a* which faces the central zone 520 and has a length of 4.5 mm and a diameter of 0.92 mm. The halide-resistant portion 551*a* extends over a distance L1 of 8 mm inside the end zone 530*a*. The end zone 530*a* has an internal diameter D of 1.00 mm. The distance L1 accordingly is greater than the internal diameter D of the end zone 530*a* augmented by 2 mm, i.e. 3.0 mm. The comparatively narrow end 558*a* and the comparatively wide end 559*a* leave respective clearances of 0.16 mm and 0.04 mm open inside the end zone 530. The ceramic seal 532*a* extends up to the comparatively wide end 559*a*, i.e. over a distance L3 of 6 mm beyond the permeable portion 552*a*. The permeable portion 552*a* is enclosed in the end zone 530*a* over a distance L2 of 7.5 mm, greater than three times the internal diameter D (3.0 mm). The lamp dissipates a power of 150 W during nominal operation.

Figure 7:
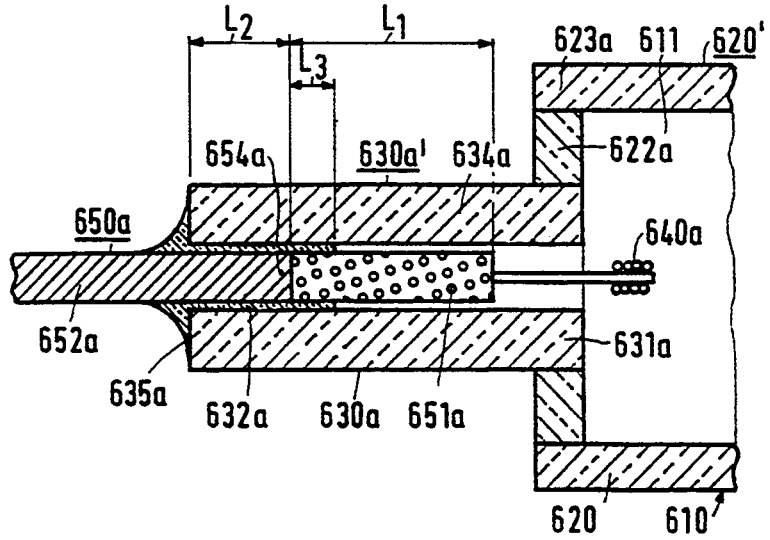

In FIG. 7, parts corresponding to those of FIG. 1 have reference numerals which are 600 higher. The end zone 630*a* has an internal diameter D of 1.00 mm. The halide-resistant portion 651*a* of the current supply conductor 650*a* is a porous body made of tungsten with a length L1 of 11 mm and a diameter of 0.92 mm which extends entirely within the end zone 630*a*. The distance L1 is greater than the internal diameter D of the end zone augmented by 2 mm (3.0 mm). The permeable portion 652*a* of the current supply conductor 650*a* is a niobium rod with a diameter also of 0.92 mm which extends over a distance of more than three times the internal diameter (3.0 mm), in this case over a distance L2 of 4.5 mm inside the end zone 630*a*. A clearance of 0.03 mm is left open in the end zone 630*a* by the halide-resistant portion 651*a*. The ceramic sealing compound 632*a* extends over a distance L3 of approximately 2 mm beyond the permeable portion 652*a*. The power consumed by the lamp during nominal operation is 150 W.

In a further embodiment, corresponding to that shown in FIG. 7, the halide-resistant portion 651*a* is a body made of a cermet of tungsten and aluminium oxide in a volume ratio of 60:40.

Figure 8:
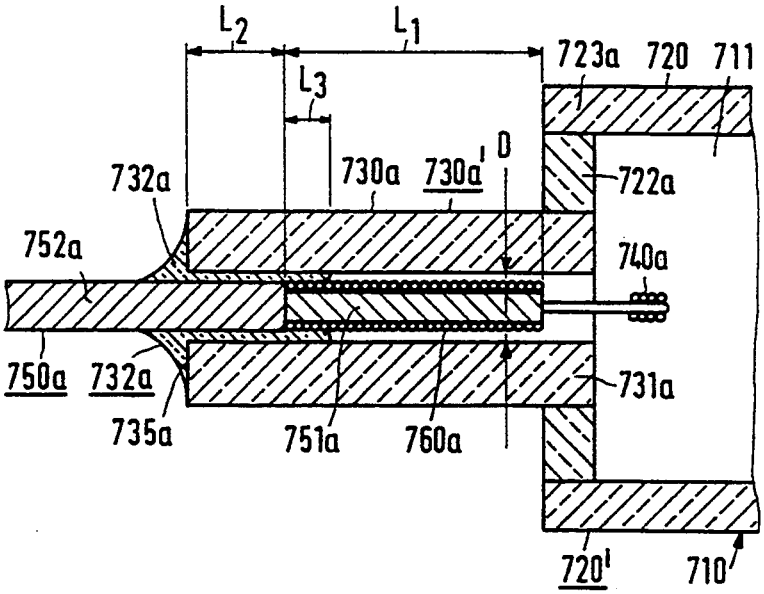

In FIG. 8, components corresponding to those of FIG. 1 have reference numerals which are 700 higher. The halide-resistant portion 751*a* is a molybdenum rod surrounded by a winding 760*a* made from a wire, also of molybdenum. In practical implementations of this embodiment, the rod has a diameter of 406 μm and the winding 760*a* is made from wire of 129 μm, 139 μm and 145 μm diameter. The end zone 730*a* here has an internal diameter D of 760 μm. The space remaining between the inner surface of the end zone 730*a* and the wire surface facing this zone in these implementations is 48 μm, 38 μm and 32 μm, respectively. A winding 760*a* made from wire of 139 μm diameter was found to be very favourable. The halide-resistant portion 751*a* has a length of 8.5 mm and extends over a distance L1 of the same length inside the end zone 730*a*. The distance L1 accordingly is more than the internal diameter D of the end zone 730*a* augmented by 2 mm (2.76 mm). The halide-resistant portion 751*a* is enclosed in the seal 732*a* of melting ceramic over a length L3 of 1 mm. The permeable portion 752*a* is a solid niobium rod. The latter extends over a distance L2 of 2 mm into the end zone 730*a*. The lamp consumes a power of 70 W during operation.

In an alternative practical implementation of this embodiment, the halide-resistant portion 751*a* has a diameter of, for example, 335 μm, the internal diameter of the end zone 730*a* is 660 μm, and the wire from which the winding 760*a* is manufactured has a diameter of, for example, 111 or 129 μm.

We claim:

1. A high-pressure discharge lamp, comprising:

a ceramic discharge vessel enclosing a discharge space, said discharge vessel including within said discharge space an ionizable filling comprising a metal halide, a first and second discharge electrode, and a respective current conductor connected to each discharge electrode, said discharge vessel further comprising a central zone extending between the electrodes and a first and a second end zone which are connected to the central zone, each end zone surrounding with little clearance a respective said current supply conductor, and a respective seal of ceramic sealing compound through which each said current supply conductor issues to the exterior, the central zone having a smallest external diameter, at least the first end zone has an external diameter smaller than the smallest external diameter of the central zone and the current supply conductor through the first end zone has a halide-resistant portion facing the discharge space and a portion which is permeable to hydrogen and oxygen remote from the discharge space, the halide-resistant portion of the current supply conductor extending inside the first end zone over a distance L1 which is at least the internal diameter D of the first end zone augmented by 2 mm, and the current supply conductor through the second end zone has an additional halide-resistant portion which faces towards the discharge space.

2. A high-pressure discharge lamp as claimed in claim 1, characterized in that the permeable portion of the current supply conductor is made from a material comprising at least one of niobium and tantalum.

3. A high-pressure discharge lamp as claimed in claim 2, characterized in that at least the surface of the halide-resistant portion is manufactured from a material which comprises at least one of (i) the metals from the group formed by tungsten, molybdenum, platinum, iridium, rhenium and rhodium, and (ii) an electrically conducting silicide, carbide or nitride of at least one of tungsten, molybdenum, platinum, iridium, rhenium and rhodium.

4. A high-pressure discharge lamp as claimed in claim 3, characterized in that the halide-resistant portion extends to inside the seal of ceramic sealing compound.

5. A high-pressure discharge lamp as claimed in claim 4, characterized in that the permeable portion extends within the first end zone over a distance L2 which is at least three times the internal diameter of the first end zone.

6. A high-pressure discharge lamp as claimed in claim 5, characterized in that the halide-resistant portion is a solid rod of halide-resistant material.

7. A high-pressure discharge lamp as claimed in claim 6, characterized in that the halide-resistant portion of the current supply conductor has a comparatively narrow end adjoining the permeable portion and a comparatively wide end facing the central zone of the discharge vessel.

8. A high-pressure discharge lamp as claimed in claim 5, characterized in that the current supply conductor comprises a rod of permeable material, while the halide-resistant portion is formed by a portion of the rod which is provided with a layer of halide-resistant material.

9. A high-pressure discharge lamp as claimed in claim 5, characterized in that the halide-resistant portion of the current supply conductor is a body made from a cermet of a ceramic material with one or several halide-resistant metals.

10. A high-pressure discharge lamp as claimed in claim 6, characterized in that the halide-resistant portion is surrounded by a winding made from one of (i) the metals from the group formed by tungsten, molybdenum, platinum, iridium, rhenium and rhodium, and (ii) an electrically conducting silicide, carbide or nitride of at least one of tungsten, molybdenum, platinum, iridium, rhenium and rhodium.

11. A high-pressure discharge lamp as claimed in claim 10, characterized in that an end of a tube forming the first end zone, which end faces towards the central zone, is fixed in a ceramic ring which is fastened in a respective end of a tube forming the central zone.

12. A high-pressure discharge lamp as claimed in claim 2, characterized in that at least the surface of the halide-resistant portion is manufactured from a material which comprises at least one of (i) the metals from the group formed by tungsten, molybdenum, platinum, iridium, rhenium and rhodium, and (ii) an electrically conducting silicide, carbide or nitride of at least one of tungsten, molybdenum, platinum, iridium, rhenium and rhodium.

13. A high-pressure discharge lamp as claimed in claim 2, characterized in that the halide-resistant portion extends to inside the seal of ceramic sealing compound.

14. A high-pressure discharge lamp as claimed in claim 1, characterized in that the halide-resistant portion extends to inside the seal of ceramic sealing compound.

15. A high-pressure discharge lamp as claimed in claim 1, characterized in that the permeable portion extends within the first end zone over a distance L2 which is at least three times the internal diameter of the first end zone.

16. A high-pressure discharge lamp as claimed in claim 1, characterized in that the halide-resistant portion is a solid rod of halide-resistant material.

17. A high-pressure discharge lamp as claimed in claim 1, characterized in that the current supply conductor comprises a rod of permeable material, while the halide-resistant portion is formed by a portion of the rod which is provided with a layer of halide-resistant material.

18. A high-pressure discharge lamp as claimed in claim 1, characterized in that the halide-resistant portion of the current supply conductor is a body made from a cermet of a ceramic material with one or several halide-resistant metals.

19. A high-pressure discharge lamp as claimed in claim 1, characterized in that an end of a tube forming the first end zone, which end faces towards the central zone, is fixed in a ceramic ring which is fastened in a respective end of a tube forming the central zone.

* * * * *